United States Patent [19]

Johnson

[11] Patent Number: 4,807,889

[45] Date of Patent: Feb. 28, 1989

[54] ARROWHEAD

[76] Inventor: Ronald W. Johnson, Box 460, Starbuck, Minn. 56381

[21] Appl. No.: 38,638

[22] Filed: Apr. 15, 1987

[51] Int. Cl.[4] ..... F41B 5/02

[52] U.S. Cl. ..... 273/422

[58] Field of Search ..... 273/422

[56] References Cited

U.S. PATENT DOCUMENTS

| | | | |
|---|---|---|---|
| 2,940,758 | 6/1960 | Richter | 273/422 |
| 3,756,600 | 9/1973 | Maleski | 273/422 |
| 3,915,455 | 10/1975 | Savora | 273/422 |
| 4,146,226 | 3/1979 | Sorensen | 273/422 |
| 4,169,597 | 10/1979 | Maleski | 273/422 |
| 4,210,330 | 7/1980 | Kosbab | 273/422 |
| 4,381,866 | 5/1983 | Simo | 273/422 |
| 4,410,184 | 10/1983 | Anderson | 273/422 |
| 4,537,404 | 8/1985 | Castellano et al. | 273/422 |

*Primary Examiner*—Paul E. Shapiro

*Attorney, Agent, or Firm*—Kinney & Lange

[57] ABSTRACT

An arrowhead assembly comprising an elongated body with longitudinally oriented slots spaced about the periphery of the body, and a bore extending inwardly from a forward end of the body. The slots have an opening portion which extends deep enough into the body to open into the bore. Removable blades are engaged in the slots. Each blade has a rearwardly projecting tongue extending into the bore through the opening portion of the slot. The blades are secured in place by a removable tip screwed onto the forward end of the body.

16 Claims, 2 Drawing Sheets

ARROWHEAD

BACKGROUND OF THE INVENTION

1. Field of the Invention

This invention relates to a broadhead arrowhead structure having a body and one or more replaceable razor-type blades spaced around the periphery of the body.

2. Description of the Prior Art

Broadhead arrowheads are in widespread use for hunting game. These arrowheads are generally formed by a body which has a plurality of blades and a tip mounted thereon. The arrowhead is then secured to an end of an arrow shaft, typically by means of a threaded shaft on a rearward end of the arrowhead. Arrowheads of these and other types are disclosed, for example, in the following U.S. Pat. Nos.:

Richter 2,940,758
Maleski 3,756,600
Savora 3,915,455
Sorenson 4,169,597
Anderson 4,410,184
Maleski 4,169,597
Castellano et al. 4,537,404

Castellano et al. disclose an arrowhead structure with blades having forwardly extending tongues which extend into an undercut recess of a slot in a body portion. The arrowhead must be threaded onto an arrow shaft to lock the blades in operating position. It is therefore inconvenient to use. Effectiveness of this arrowhead will also be reduced by loose blades should the arrowhead be loose on the shaft when the arrow is used.

There is a continuing need for improved broadhead arrowheads. The arrowhead should be designed in such a manner that the blades can be releasably secured to the arrowhead independent from the arrow shaft. An arrowhead which is still functional if the tip should loosen or if the arrowhead should loosen from the shaft, is also desirable. An arrowhead in which the blades lock more securely to the body upon impact is also desired. The arrowhead must, of course, be relatively easy and inexpensive to manufacture to be commercially viable.

SUMMARY OF THE INVENTION

The present invention is an arrowhead assembly which is adapted for attachment to an arrow shaft. The assembly includes an elongated body having a forward end and a rearward end. A bore extends into the body from one of the forward and rearward ends. At least one longitudinally oriented slot is located on the periphery of the body, and has a portion which extends deep enough into the body so as to open into the bore. A blade engaged in the slot extends radially outward from the body. The blade has a forward end and a rearwardly projecting tongue extending into the bore and underlying and engaging an adjacent portion of the body. A forward end of the body includes tip receiving means. A tip adapted to be received by the tip receiving means engages the forward end of the blade and secures the blade onto the body. Fastening means on the rearward end of the body fasten the arrowhead assembly to the arrow shaft.

Blades of an arrowhead in accordance with the present invention are positively locked to the body independent from the arrow shaft. The blades will not, therefore, come loose should the arrowhead be loosened from the arrow shaft. Since the tongue extends rearwardly, the blades will be securely forced into the body upon impact with an object. Even if the tip is loosened from the body, the blades will still be retained on the body at impact. Furthermore, the arrowhead of the present invention will still be functional even if the tip is loosened from the body.

DETAILED DESCRIPTION OF THE PREFERRED EMBODIMENTS

Figure 1:
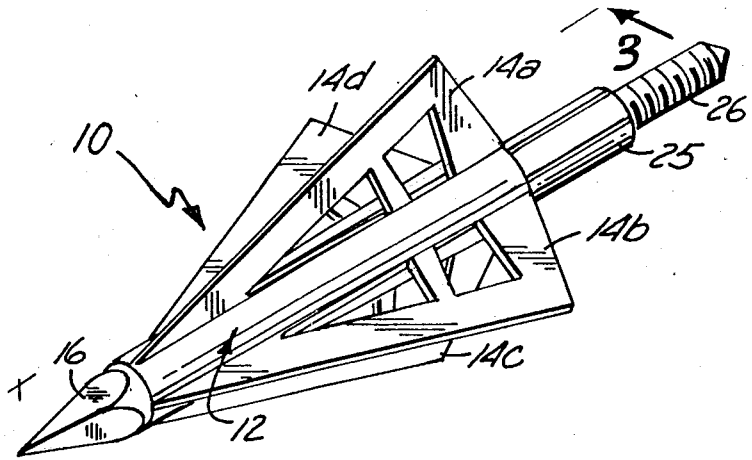
FIG. 1 is a perspective view of an arrowhead assembly embodying the present invention.
Figure 2:
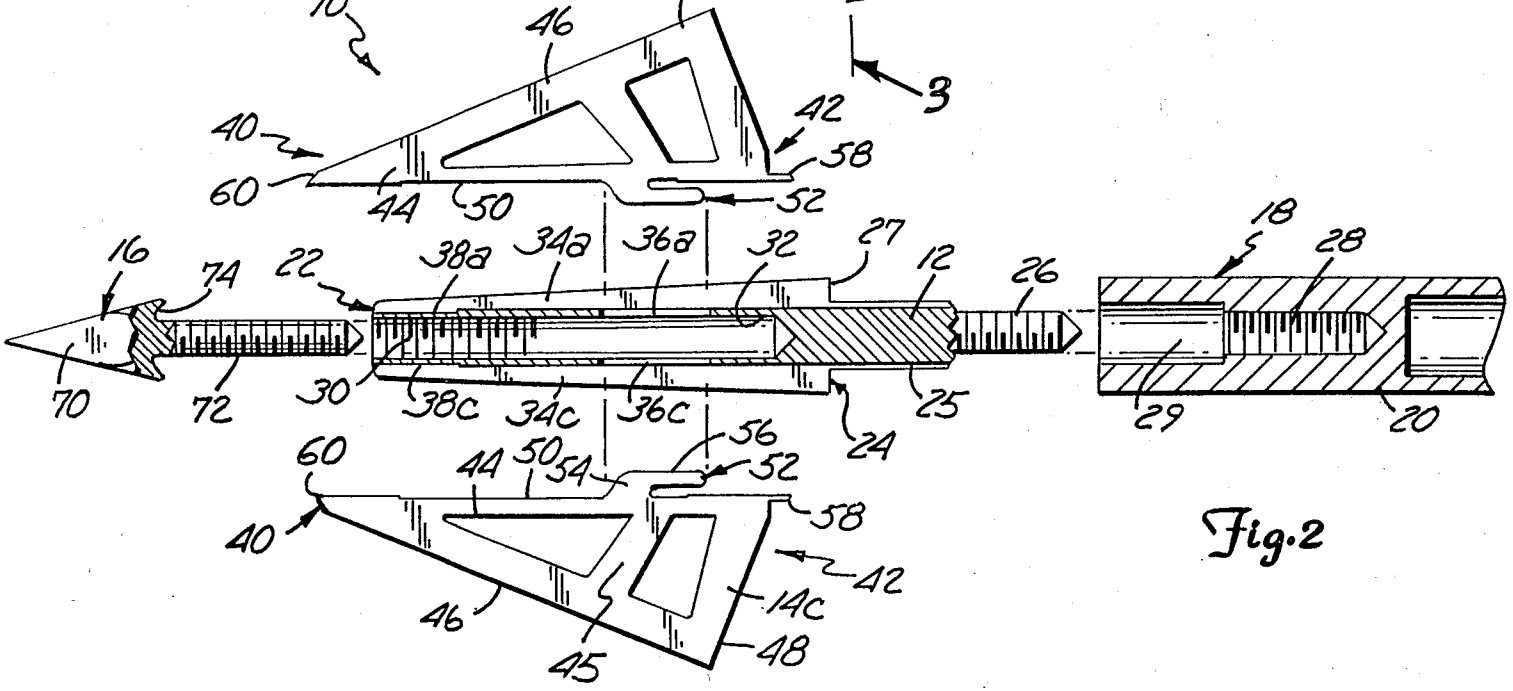
FIG. 2 is an exploded side view of the arrowhead illustrated in FIG. 1 along with an arrow shaft, with portions cut away.
Figure 3:
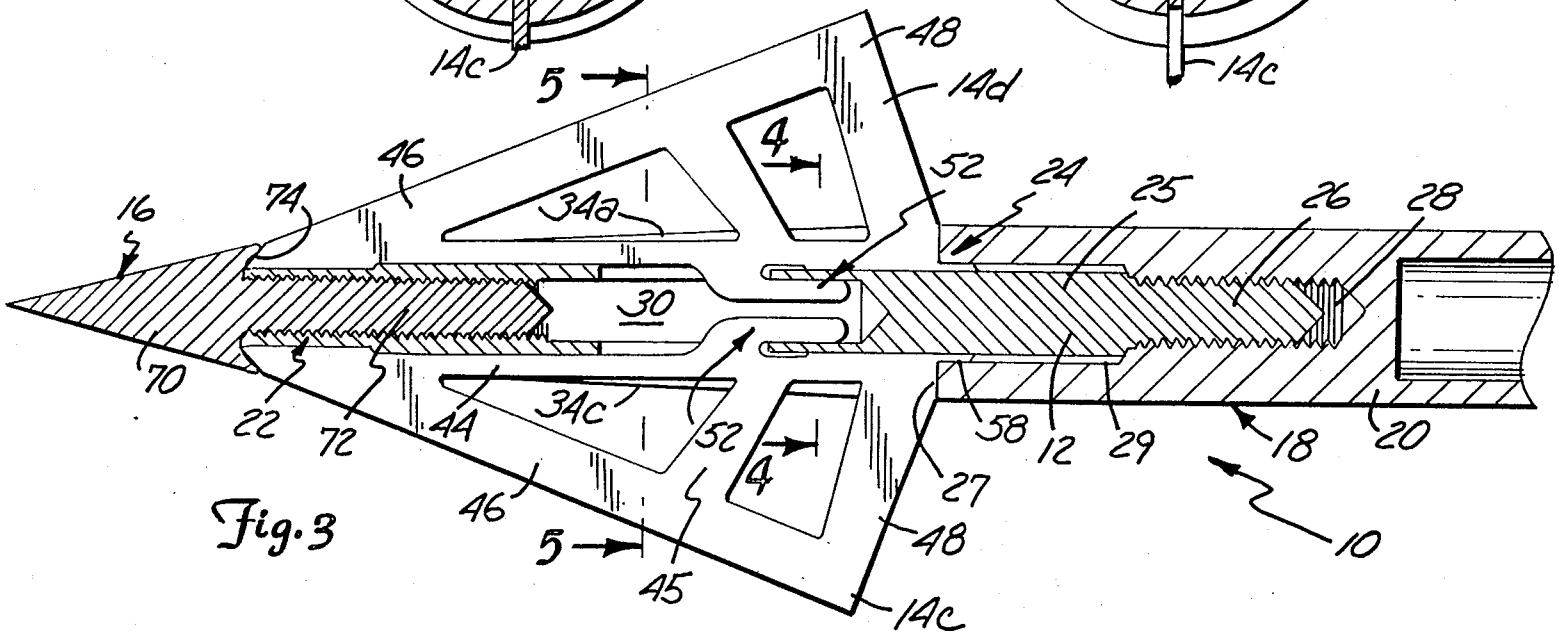
FIG. 3 is a side view of the arrowhead and arrow shaft shown in FIG. 2, with portions cut away to illustrate how the blades and tip are held in place and also how the arrowhead is secured onto the arrow shaft.

An arrowhead assembly 10 in accordance with the present invention is illustrated generally in FIGS. 1–5. Arrowhead 10 includes an elongated body 12, four blades **14*a*–14*d*, and a tip 16. As will be described below, blades 14*a*–14*d* and tip 16 are independently and positively secured to body 12. Arrowhead assembly 10 is adapted to be mounted to a tip end 18 of an arrow shaft 20 as illustrated in FIGS. 2 and 3**.

Figure 5:
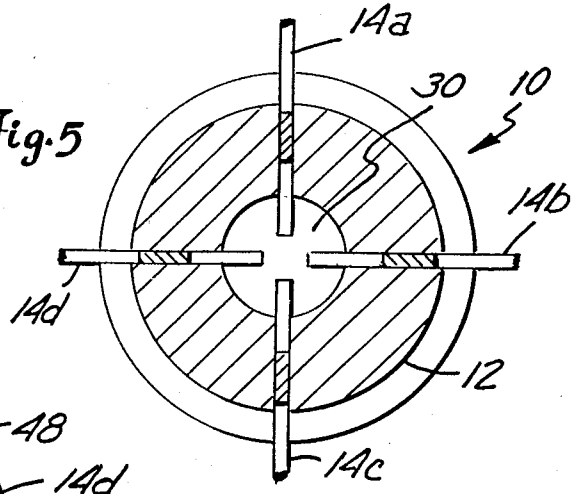
FIG. 5 is a transverse sectional view of the arrowhead as seen along sectioning line of 5—5 of FIG. 3.
Figure 4:
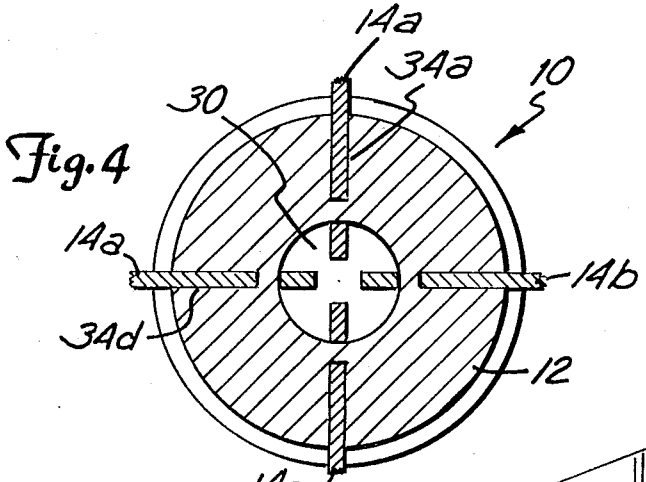
FIG. 4 is a transverse sectional view of the arrowhead as seen along sectioning line of 4—4 of FIG. 3.

As perhaps best shown in FIGS. 2 and 3, body 12 is elongated and has a forward end 22 and a rearward end 24. As illustrated in FIGS. 4 and 5, body 12 is generally circular in cross section. Rearward end 24 has a diameter which is greater than a diameter of forward end 22, with body 12 being tapered therebetween. Rearward end 24 of body 12 also includes a reduced diameter shaft-fitting portion 25 with an edge 27. A threaded shaft 26 extends from portion 25 of body 12, and is adapted to be screwed into threaded bore 28 of arrow shaft 20. Portion 25 of body 12 fits within a recess 29 in end 18 of arrow shaft 20.

Body 12 also includes a cavity 30 between its forward end 22 and its rearward end 24. In the embodiment shown, cavity 30 is formed by a bore extending inwardly into body 12 from forward end 22, and has an inside surface 32. An inside surface of cavity 30 adjacent forward end 22 is threaded.

Body 12 also includes four longitudinally oriented slots **34*a*–34*d* which extend between forward end 22 and rearward end 24. As perhaps best shown in FIG. 2, slots 34*a*–34*d* are generally at a constant depth with respect to a central longitudinal axis of body 12 (not shown), and to inside surface 32 of cavity 30. Slots 34*a*–34*d* also have an opening section 36*a*–36*d*, respectively, in a midsection between ends 22 and 24, which extend into cavity 30 (only openings 36*a* and 36*c* are visible in FIG. 2). Slots 34*a*–34*d* also include a recessed section 38*a*–38*d* which is recessed closer to inside surface 32 of cavity 30. Slots 34*a*–34*d* extend all the way from forward end 22 to threaded shaft 28** in the embodiment shown.

Throughout this specification, like reference numerals are used to identify like elements of blades **14*a*–14*d*. Blades 14*a*–14*d* have a forward end 40** and a rearward end 42. A body-receiving edge section 44 extends between forward end 40 and rearward end 42 of blades 14a–14d. Blades 14a–14d also include a knife edge section 46 which generally forms a first angle with respect to body-receiving edge section 44, and intersects the body-receiving edge section at forward end 40. Tips 60 of knife edge sections 46 form a section greater angle with respect to body-receiving edge section 44 in the embodiment shown. Blades 14a–14d also include a rear edge section 48 which joins edge sections 44 and 46 at rearward end 42, and a brace section 45 which joins edge sections 44 and 46 at a location between ends 40 and 42. Blades 14a–14d also include a tail 58 which extends rearwardly from rearward end 42, and forms an end of body-receiving edge 14.

Body receiving edge sections 44 of blades 14a–14d have a generally straight edge and include a recessed edge portion 50 and a rearwardly extending tongue 52. Tongue 52 includes a first section 54 which extends in a generally perpendicular direction from edge section 44, and a rearward extending portion 56 which is generally parallel to and spaced from edge section 44. Blades 14a–14d are fit within slots 34a–34d, respectively, of body 12 with their tongues 52 fit into opening sections 36a–36d, respectively. Blades 14a–14d are then slid rearward, with portions 56 of tongue 52 being fit within cavity 30, underlying inside surface 32 of the cavity. Tongues 52 thereby engage body 12 and hold blades 14a–14d thereon. Tail 58 of blades 14a–14d fit into the portion of slots 34a–34d, respectively, in portion 25 of body 12, and are flush with an outer surface thereof.

Tip 16 includes a tip member 70, and a threaded shaft 72 which extends rearwardly therefrom. Tip member 70 is preferably fabricated of hardened metal, and includes four bevels which define four edges and a point. A rearward surface 74 of tip member 70 which is adjacent shaft 72 is recessed. Tip 16 is screwed into the threaded bore of body 12, with the recessed surface 74 engaging tips 60 of blades 14a–14d, and securing the blades into their engaged position on body 12. Arrowhead assembly 10 can then be screwed into arrow shaft 20. Tails 58 of blades 14a–14d and portion 25 of body 12 will fit within recess 29 of arrow shaft 20 for further support of the blades. When assembly 10 is screwed onto arrow 20, blades 14a–14d are secured to body 12 at their tips 60, tongues 52, and tails 58.

Arrowhead 10 has considerable advantages over those of the prior art. Blades 14 are positively secured to body 12 independent of shaft 20, and will therefore not come free when the assembly is removed from arrow shaft 20. Arrowhead 10 is therefore convenient to use. The rearwardly extending tongues 52 which are clamped to body 12 by tip 16 ensure that the blades will be securely locked into body 12 upon impact. Even if tip 16 should loosen, arrowhead assembly 10 is still functional since blades 14a–14d will be forced rearwardly into engagement with body 12 upon impact. Furthermore, blades 14a–14d will not become loosened from body 12 should assembly 10 be loosened from arrowhead shaft 20, as can happen when assembly 10 impacts an object and shaft 20 continues to rotate.

Although the present invention has been described with reference to preferred embodiments, workers skilled in the art will recognize that changes may be made in form and detail without departing from the spirit and scope of the invention.

What is claimed is:

1. An arrowhead assembly for attachment to an arrow shaft, comprising:

an elongated body having a forward end and a rearward end;

a bore extending into the body from one of the forward and rearward ends, and forming a cylindrical wall having a thickness equal to a first dimension;

at least one longitudinally oriented slot located on the periphery of the body, with a portion of the slot extending through the wall into the bore;

a blade engaged in the slot and having a blade body extending radially outward from the elongated body, the blade having a forward end and a rearwardly projecting tongue extending into the bore and underlying and engaging an adjacent portion of the elongated body, wherein the tongue includes an inwardly projecting portion having a length greater than the first dimension and projecting through the slot from the blade body, and a rearwardly projecting portion having a length greater than the first dimension and projecting rearwardly within the bore from the inwardly projecting portion;

tip receiving means for receiving a tip on the forward end of the body;

a tip adapted to be received by the tip receiving means and engaging the forward end of the blade for securing the blade onto the body by forcing the tongue rearwardly into engagement with the cylindrical wall; and fastening means on the rearward end of the body for fastening the assembly to an arrow shaft.

2. The arrowhead assembly of claim 1 wherein the bore extends into the body from the forward end.

3. The arrowhead assembly of claim 1 wherein the forward end of the body has a diameter which is less than a diameter of the rearward end.

4. The arrowhead assembly of claim 1 wherein the forward end of the body is circular in cross section.

5. The arrowhead assembly of claim 1 wherein the slot runs the length of the body.

6. The arrowhead assembly of claim 1 wherein a forward portion of the slot is recessed.

7. The arrowhead assembly of claim 1 wherein the portion of the slot opening into the bore is located at a midsection of the body.

8. The arrowhead assembly of claim 1 wherein a length of the portion of the slot extending through the bore is at least as long as the rearwardly projecting tongue.

9. The arrowhead assembly of claim 1 wherein the blade has a body-receiving edge section which is recessed at a location between its forward and rearward ends.

10. The arrowhead of claim 1 wherein the blade has a body-receiving edge section and includes a rearwardly projecting tail extending from a rearward end.

11. An arrowhead assembly as described in claim 1 wherein the tip includes four bevels defining four edges and a point.

12. The arrowhead of claim 1 wherein a rearward end of the tip includes a recess adapted to engage a tip of the blade.

13. The arrowhead assembly of claim 1 wherein:

the tip receiving means includes a threaded bore in the forward end of the body; and the tip includes a threaded shaft extending from a rearward end thereof.

14. An arrowhead assembly of claim 1 wherein the fastening means includes a threaded shaft.

15. An arrowhead assembly for attachment to an arrow shaft, comprising:

an elongated body having forward and rearward ends;

a threaded bore extending into the body from the forward end and forming a cylindrical wall having a thickness equal to a first dimension;

a plurality of longitudinally oriented slots located on a periphery of the elongated body, with a midsection portion of the slot extending through the wall into the bore;

a plurality of blades engaged in the slots and extending radially outward from the elongated body, each blade having a blade body and a rearwardly projecting tongue extending into the bore through the midsection portion of the slot and underlying and engaging an adjacent portion of the elongated body, wherein the tongue includes an inwardly projecting portion having a length greater than the first dimension and projecting through the slot from the blade body, and a rearwardly projecting portion having a length greater than the first dimension and projecting rearwardly within the bore from the inwardly projecting portion;

a tip having a recessed tip portion and a threaded shaft extending therefrom for securing the blades onto the elongated body by forcing the tongues rearwardly into engagement with the cylindrical wall, the threaded shaft cooperating with the threaded bore, and tips of the blades fitting into the recessed tip portion; and fastening means on the rearward end of the body for fastening the arrowhead assembly to an arrow shaft.

16. An arrowhead assembly as described in claim 15 wherein each blade includes a rearward projecting tail portion.

* * * * *